US009828657B2

(12) United States Patent
Abe et al.

(10) Patent No.: US 9,828,657 B2
(45) Date of Patent: Nov. 28, 2017

(54) NI-BASE SUPER ALLOY

(71) Applicant: HITACHI METALS, LTD., Tokyo (JP)

(72) Inventors: Ryutaro Abe, Shimane (JP); Takehiro Ohno, Shimane (JP); Shinichi Kobayashi, Shimane (JP); Tomonori Ueno, Shimane (JP); Chuya Aoki, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/512,272

(22) PCT Filed: Sep. 28, 2015

(86) PCT No.: PCT/JP2015/077349
§ 371 (c)(1),
(2) Date: Mar. 17, 2017

(87) PCT Pub. No.: WO2016/052423
PCT Pub. Date: Apr. 7, 2016

(65) Prior Publication Data

US 2017/0275736 A1 Sep. 28, 2017

(30) Foreign Application Priority Data

Sep. 29, 2014 (JP) ..... 2014-199307
Mar. 27, 2015 (JP) ..... 2015-066606

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22C 19/056; C22F 1/10
See application file for complete search history.

(56) References Cited

U.S. PATENT DOCUMENTS 4,253,885 A 3/1981 Maurer
4,957,567 A 9/1990 Krueger et al.
5,649,280 A 7/1997 Blankenship et al.
(Continued)

FOREIGN PATENT DOCUMENTS

EP 1640465 A2 3/2006
EP 2467505 A1 6/2012
(Continued)

OTHER PUBLICATIONS

International Search Report dated Dec. 15, 2015 filed in PCT/JP2015/077349.
(Continued)

*Primary Examiner* — Jessee Roe
(74) *Attorney, Agent, or Firm* — Rankin, Hill & Clark LLP

(57) ABSTRACT

There is provided an Ni-base super alloy which is used for airplane engines and gas turbines for power generation and has favorable mechanical properties at high temperature. The Ni-base super alloy contains 0.001 to 0.1 mass % of C, 1.0 to 4.0 mass % of Al, 2.0 to 4.5 mass % of Ti, 12.0 to 18.0 mass % of Cr, 11.1 to 18.0 mass % of Co, 1.2 to 12.0 mass % of Fe, 1.5 to 6.5 mass % of Mo, 0.5 to 6.0 mass % of W, 0.1 to 3.0 mass % of Nb, 0.001 to 0.05 mass % of B, 0.001 to 0.1 mass % of Zr, and Ni and impurities as a remainder.

1 Claim, 1 Drawing Sheet

(56) References Cited

U.S. PATENT DOCUMENTS

| | | | |
|---|---|---|---|
| 2006/0051234 | A1 | 3/2006 | Pike, Jr. |
| 2006/0157171 | A1 | 7/2006 | Shimizu |
| 2006/0222557 | A1 | 10/2006 | Pike, Jr. |
| 2012/0183432 | A1 | 7/2012 | Devaux |

FOREIGN PATENT DOCUMENTS

| | | | |
|---|---|---|---|
| JP | 5635742 | | 4/1981 |
| JP | 200670360 | | 3/2006 |
| JP | 2006225756 | A2 | 8/2006 |
| JP | 2014156660 | A2 | 8/2014 |
| WO | 2014126086 | A1 | 8/2014 |

OTHER PUBLICATIONS

First & Sole Office Action dated May 13, 2016 for the corresponding Japanese Patent Application No. 2016-510891.
Extended European Search Report dated Sep. 9, 2017 for the corresponding European Patent Application No. 15846655.7.

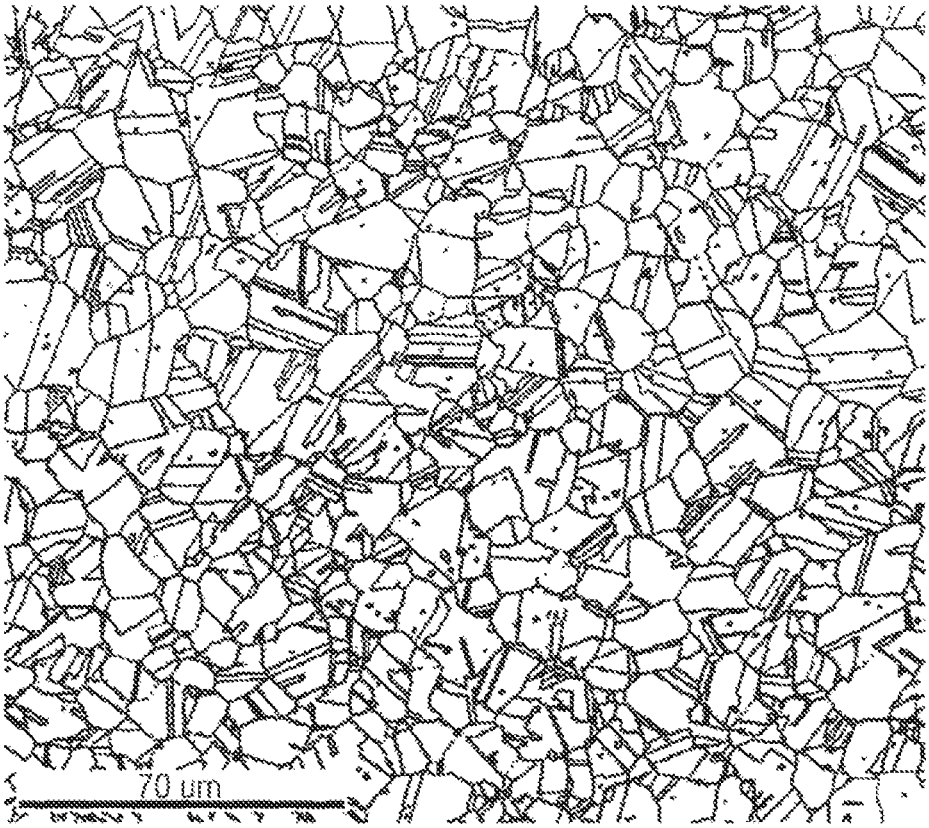
70 um

NI-BASE SUPER ALLOY

TECHNICAL FIELD

The present invention relates to an Ni-base super alloy.

BACKGROUND ART

As a heat-resistant member included in the engines for airplanes and the gas turbines for power generation, there is used a γ' (gamma prime)-phase precipitation strengthening-type Ni-base super alloy which contains many alloy elements such as Al and Ti.

There has been used a forged alloy as an Ni-base super alloy in a turbine disk, among turbine components, which is required to have high strength and reliability. Here, the term "forged alloy" is used in comparison to a cast alloy which is used with a cast and solidified structure as it is. A forged alloy is a material which is manufactured by a process in which a steel ingot obtained by melting and solidification is subjected to hot working into a predetermined component shape. The hot working transforms a coarse, heterogeneous cast and solidified structure into a fine, uniform forged structure. This improves mechanical properties such as tensile strength and fatigue properties. In a low-pressure turbine disk for airplane engines, there is used an Ni-base super alloy including a γ' phase as a strengthening phase, as disclosed in JP-A-2014-156660 (Patent Literature 1). However, in recent years, the turbine inlet temperature further increases due to the improvement in fuel consumption and efficiency, and the high temperature strength of a super alloy used is required to accordingly improve.

CITATION LIST

Patent Literature

Patent Literature 1: JP-A-2014-156660

SUMMARY OF INVENTION

Problems to be Solved by the Invention

The above-described Ni-base super alloy disclosed in Patent Literature 1 is developed with the intention of the use in, for example, a low-pressure turbine disk for airplane engines. However, if the turbine inlet temperature further increases due to the improvement in fuel consumption and efficiency in the future, insufficient mechanical properties at a high temperature of, for example, 650° C. or higher, will become a significant problem.

An object of the present invention is to provide an Ni-base super alloy which is used in airplane engines, gas turbines for power generation, and the like, and which has favorable mechanical properties at a high temperature of 650° C. or higher.

Solutions to the Problems

The present invention has been achieved in consideration of the above-described problems.

An Ni-base super alloy according to the present invention contains 0.001 to 0.100 mass % of C, 1.0 to 4.0 mass % of Al, 2.0 to 4.5 mass % of Ti, 12.0 to 18.0 mass % of Cr, 11.1 to 18.0 mass % of Co, 1.2 to 12.0 mass % of Fe, 1.5 to 6.5 mass % of Mo, 0.5 to 6.0 mass % of W, 0.1 to 3.0 mass % of Nb, 0.001 to 0.050 mass % of B, 0.001 to 0.100 mass % of Zr, 0.02 mass % or less of Mg, and Ni and impurities as a remainder.

In the Ni-base super alloy, preferably, (Ti+0.5Nb)/Al is 1.0 to 3.5 mass %.

In the Ni-base super alloy, more preferably, Mo+0.5 W is 3.5 to 7.0 mass %.

In the Ni-base super alloy, further more preferably, the length of twin crystal boundaries is 50% or more with respect to a sum of the length of twin crystal boundaries and the length of crystal grain boundaries.

Effects of the Invention

According to the present invention, there can be obtained a high-strength Ni-base super alloy which is used in airplane engines, gas turbines for power generation, and the like. This Ni-base super alloy has mechanical properties which is higher than those of a known Ni-base super alloy, at a high temperature of 650° C. or higher. Therefore, this Ni-base super alloy is suitable as, for example, a member such as a low-pressure turbine disk of an airplane engine.

BRIEF DESCRIPTION OF THE DRAWINGS

THE FIGURE is a view of crystal grain boundaries and twin crystal boundaries observed by electron-backscatter-diffraction.

DESCRIPTION OF EMBODIMENTS

The reason why the chemical composition has been defined in the Ni-base super alloy according to the present invention is as described below. It is noted that the chemical composition is indicated in terms of mass % unless otherwise stated.

C: 0.001 to 0.100%

C has the effect of enhancing the strength of crystal grain boundaries. This effect is expressed when C is 0.001% or more. When C is excessively contained, coarse carbides are formed, thereby reducing strength and hot workability. For this reason, the upper limit of C is 0.100%. The lower limit of C is preferably 0.005%, and more preferably 0.008%. Also, the upper limit of C is preferably 0.070%, and more preferably 0.040%.

Cr: 12.0 to 18.0%

Cr is an element which improves oxidation resistance and corrosion resistance. For obtaining the effect, 12.0% or more of Cr is necessary. When Cr is excessively contained, an embrittled phase such as a σ phase is formed, thereby reducing strength and hot workability. For this reason, the upper limit of Cr is 18.0%. The lower limit of Cr is preferably 12.5%, and more preferably 13.0%. Also, the upper limit of Cr is preferably 17.0%, and more preferably 16.0%.

Co: 11.1 to 18.0%

Co enables the stability of a structure to be improved, and the hot workability to be maintained even when Ti as a strengthening element is contained in a large amount. For obtaining the effect, 11.1% or more of Co is necessary. The larger the content of Co is, the more improvement is achieved in hot workability. However, Co is the most expensive among the contained elements. For this reason, the upper limit of Co is 18.0% in order to reduce the cost. The lower limit of Co is preferably 11.3%, and more preferably 11.5%. Also, the upper limit of Co is preferably 17.0%, and more preferably 16.5%.

Fe: 1.2 to 12.0%

Fe is an element which is used as an alternative to expensive Ni and Co, and is effective for reducing the alloy cost. For obtaining the effect, 1.2% or more of Fe is necessary. When Fe is excessively contained, an embrittled phase such as a σ phase is formed, thereby reducing strength and hot workability. For this reason, the upper limit of Fe is 12.0%. The lower limit of Fe is preferably 1.3%, and more preferably 1.5%. Also, the upper limit of Fe is preferably 11.0%, and more preferably 10.5%.

Al: 1.0 to 4.0%

Al is an essential element, and forms a γ'($Ni_3Al$) phase, which is a strengthening phase, thereby to improve high temperature strength. For obtaining the effect, at least 1.0% of Al is necessary. However, when Al is excessively added, hot workability decreases, thereby causing material defects such as a crack during working. For this reason, the added amount of Al is limited to 1.0 to 4.0%. The lower limit of Al is preferably 1.3%, and more preferably 1.5%. Also, the upper limit of Al is preferably 3.0%, and more preferably 2.5%.

Ti: 2.0 to 4.5%

Ti, similarly to Al, is an essential element, and forms a γ' phase. The γ' phase is subjected to solid solution strengthening, thereby to increase high temperature strength. For obtaining the effect, at least 2.0% of Ti is necessary. However, excessive addition of Ti causes a gamma prime phase to become unstable at high temperature which leads to the coarsening at high temperature, and also causes a hazardous η (eta) phase to be formed. Accordingly, hot workability is impaired. For this reason, the upper limit of Ti is 4.5%. The lower limit of Ti is preferably 2.5%, and more preferably 3.2%. Also, the upper limit of Ti is preferably 4.2%, and more preferably 4.0%.

Nb: 0.1 to 3.0%

Nb is, similarly to Al or Ti, an element which forms a γ' phase so that the γ' phase is subjected to solid solution strengthening to increase high temperature strength. For obtaining the effect, at least 0.1% of Nb is necessary. However, excessive addition of Nb causes a hazardous δ (delta) phase to be formed, thereby impairing hot workability. For this reason, the upper limit of Nb is 3.0%. The lower limit of Nb is preferably 0.2%, and more preferably 0.3%. Also, the upper limit of Nb is preferably 2.0%, and more preferably 1.5%.

Mo: 1.5 to 6.5%

Mo has the effect of contributing to the solid solution strengthening of a matrix thereby to improve high temperature strength. For obtaining the effect, 1.5% or more of Mo is necessary. However, when Mo becomes excessive, an intermetallic compound phase is formed, thereby impairing high temperature strength. For this reason, the upper limit of Mo is 6.5%. The lower limit of Mo is preferably 2.0%, and more preferably 2.5%. Also, the upper limit of Mo is preferably 5.5%, and more preferably 5.0%.

W: 0.5 to 6.0%

W is, similarly to Mo, an element which contributes to the solid solution strengthening of a matrix. In the present invention, 0.5% or more of W is necessary. When W becomes excessive, a hazardous intermetallic compound phase is formed, thereby impairing high temperature strength. For this reason, the upper limit of W is 6.0%. The lower limit of W is preferably 1.0%, and more preferably 1.5%. Also, the upper limit of W is preferably 5.0%, and more preferably 4.0%.

B: 0.001 to 0.050%

B is an element which increases grain boundary strength and improves creep strength and ductility. For obtaining the effect, at least 0.001% of B is necessary. On the other hand, B has the effect of significantly lowering a melting point. Also, when a coarse boride is formed, workability is impaired. In view of these, B is necessary to be controlled not to exceed 0.050%. The lower limit of B is preferably 0.003%, and more preferably 0.005%. Also, the upper limit of B is preferably 0.040%, and more preferably 0.020%.

Zr: 0.001 to 0.100%

Zr, similarly to B, has the effect of improving grain boundary strength. For obtaining the effect, at least 0.001% of Zr is necessary. On the other hand, when Zr becomes excessive, a melting point is lowered, thereby impairing high temperature strength and hot workability. For this reason, the upper limit of Zr is 0.100%. The lower limit of Zr is preferably 0.005%, and more preferably 0.010%. Also, the upper limit of Zr is preferably 0.060%, and more preferably 0.040%.

Mg: 0.02% or less

Mg is used as a desulfurization material. Also, Mg has the effect of becoming a sulfide to fix S, and the effect of improving hot workability. For this reason, Mg may be added as necessary. On the other hand, when Mg exceeds 0.02%, ductility deteriorates. Therefore, Mg is defined to be 0.02% or less.

The remainder that is other than the above-described elements is Ni. However, unavoidable impurities are naturally contained.

Next, a preferable range of an element will be described.

(Ti+0.5Nb)/Al: 1.0 to 3.5

As described above, Al, Ti and Nb are an element which forms a γ' phase to increase high temperature strength. The larger the added amount of Ti or Nb is, the higher the high temperature strength attributable to the solid solution strengthening of a γ' phase is. However, when Ti or Nb is excessively added, a hazardous η phase may be formed, thereby impairing hot workability. Therefore, the ratio between the content of Ti and Nb and the content of Al is preferably selected such that it has an appropriate value. When (Ti+0.5Nb)/Al exceeds 3.5, a hazardous phase may be precipitated. On the other hand, for achieving favorable high temperature strength, (Ti+0.5Nb)/Al is preferably 1.0 or more. When (Ti+0.5Nb)/Al is less than 1.0, high temperature strength becomes unlikely to be obtained. Therefore, in the present invention, (Ti+0.5Nb)/Al is defined to be 1.0 to 3.5. It is noted that the lower limit of (Ti+0.5Nb)/Al is preferably 1.2, and more preferably 1.5. Also, the upper limit of (Ti+0.5Nb)/Al is preferably 3.0, and more preferably 2.5. It is noted that the atomic weight ratio between Ti and Nb is 1:2. The contribution of Nb to the formation of a γ' phase per mass is half that of Ti. For this reason, calculation is performed with 0.5Nb.

Mo+0.5 W: 3.5 to 7.0

As described above, Mo and W have the effect of contributing to the solid solution strengthening of a matrix thereby to improve high temperature strength. The atomic weight ratio between Mo and W is 1:2. For this reason, the contribution of W to the solid solution strengthening per mass is half that of Mo. Therefore, for improving high temperature strength attributable to the solid solution strengthening of a matrix, Mo+0.5 W is preferably 3.5 mass % or more. However, excessive addition of these causes an intermetallic compound phase to be formed, thereby impairing high temperature strength. For this reason, the upper limit of Mo+0.5 W is defined to be 7.0%. The lower limit of Mo+0.5 W is preferably 3.7%, and more preferably 4.0%. Also, the upper limit of Mo+0.5 W is preferably 6.5%, and more preferably 6.0%.

Next, a preferable microstructure will be described.

The finer the crystal grains of a microstructure of the Ni-base super alloy according to the present invention is, the higher the proof stress at high temperature is. Therefore, the ASTM crystal grain size number of the crystal grains is preferably 6 or more, and more preferably 7 or more. On the other hand, when the crystal grains are excessively fine, propagation of cracking is facilitated, thereby impairing creep strength. For this reason, the crystal grain size is preferably 12 or less.

The present inventors found that for obtaining favorable mechanical properties at high temperature, the length of twin crystal boundaries of an Ni-base superalloy is preferably 50% or more of a sum of the length of twin crystal boundaries and the length of crystal boundaries.

A twin crystal refers to two neighboring crystals are symmetrical about a certain plane or axis. A twin crystal is, for example, a crystal containing two neighboring crystal grains which are mirror symmetrical about a surface (referred to as a twin crystal surface) that includes crystal lattices of the two neighboring crystal grains and appears to be linear in the crystal grains in THE FIGURE. Such a state can be confirmed through structure observation by, for example, electron-backscatter-diffraction (EBSD) or the like.

The energy necessary for introducing the stacking fault of a unit area into a perfect crystal is referred to as stacking fault energy. The lower the stacking fault energy is, the more twin crystals are produced. As the amount of twin crystals increases, that is, as the length of the boundaries of twin crystals with respect to the length of crystal grain boundaries increases, the twin crystal boundaries further inhibit the movement of dislocation. It is considered that this enables creep strength at high temperature to be improved. For obtaining favorable creep strength, the stacking fault energy is reduced such that the length of twin crystal boundaries with respect to a sum of the length of twin crystal boundaries and the length of crystal grain boundaries is preferably 50% or more. This length is further preferably 52% or more, and more preferably 55% or more.

For obtaining the microstructure defined in the present invention, the following manufacturing method, for example, is preferably employed.

First, the above-described Ni-base super alloy defined by the present invention is subjected to hot working with a forging ratio of 3 or more at the γ' phase solution temperature or lower, thereby to impart processing strain. Thereafter, the Ni-base super alloy is subjected to a solid solution treatment at the γ' phase solution temperature or lower. The upper limit of the solid solution treatment temperature is defined to be the solution temperature of the γ' phase, and the lower limit of the solid solution treatment temperature is defined to be 100° C. lower than the solution temperature. The solid solution treatment may be performed within such a range. The treatment time is preferably selected from the range of 0.5 to 10 hours. After the solid solution treatment, an aging treatment for precipitation strengthening can be performed. The aging treatment temperature is defined to be preferably 600 to 800° C. The aging treatment time may be selected from the range of 1 to 30 hours.

EXAMPLES

The present invention will be described in further detail by referring to the following examples.

By vacuum melting, 10 kg of an ingot was prepared. Thereafter, hot forging was performed at a temperature of not higher than the solution temperature of the γ' phase of each alloy and within 80° C. from the solution temperature, such that the forging ratio becomes 3 or more. Thus, a hot forged material was prepared. Thereafter, the hot forged material was subjected to a solid solution treatment and an aging treatment at a temperature of not higher than the solution temperature of γ'. The chemical composition of the melted ingot is indicated in Table 1. Furthermore, the calculation value of (Ti+0.5Nb)/Al, and the calculation value of Mo+0.5 W are illustrated in Table 2. The conditions for the solid solution treatment and the aging treatment are indicated in Table 3.

It is noted that Nos. 1 to 4 correspond to examples of the present invention, and Nos. 11 to 15 correspond to comparative examples. Also, the calculation value of (Ti+0.5Nb)/Al and the calculation value of Mo+0.5 W for the present invention example No. 1 are 1.82 and 5.75 respectively. The calculation value of (Ti+0.5Nb)/Al and the calculation value of Mo+0.5 W for No. 2 are 2.11 and 6.0 respectively. The calculation value of (Ti+0.5Nb)/Al and the calculation value of Mo+0.5 W for No. 3 are 2.16 and 5.9 respectively. The calculation value of (Ti+0.5Nb)/Al and the calculation value of Mo+0.5 W for No. 4 are 1.95 and 4.75 respectively. No. 11 is the known alloy disclosed in Patent Literature 1.

TABLE 1

| No | C | Al | Ti | Cr | Co | Fe | Mo | W | Nb | B | Zr | Mg |
|---|---|---|---|---|---|---|---|---|---|---|---|---|
| 1 | 0.017 | 2.2 | 3.5 | 15.7 | 12.3 | 4.0 | 3.8 | 3.9 | 1.0 | 0.015 | 0.033 | 0.004 |
| 2 | 0.015 | 1.9 | 3.8 | 15.1 | 15.9 | 2.1 | 4.9 | 2.2 | 0.4 | 0.008 | 0.030 | 0.005 |
| 3 | 0.017 | 1.9 | 3.9 | 15.0 | 16.0 | 2.0 | 4.8 | 2.2 | 0.4 | 0.009 | 0.030 | 0.004 |
| 4 | 0.015 | 2.1 | 3.8 | 14.5 | 12.1 | 9.8 | 3.0 | 3.5 | 0.6 | 0.014 | 0.032 | 0.004 |
| 11 | 0.018 | 2.3 | 3.4 | 15.6 | 8.6 | 4.0 | 3.1 | 2.7 | 1.1 | 0.010 | 0.032 | 0.005 |
| 12 | 0.016 | 2.2 | 3.7 | 15.9 | 13.2 | 1.0 | 4.0 | 4.0 | 0.7 | 0.013 | 0.028 | 0.004 |
| 13 | 0.016 | 2.3 | 3.8 | 15.9 | 8.6 | 4.0 | 2.3 | 4.2 | 0.5 | 0.009 | 0.028 | 0.003 |
| 14 | 0.018 | 2.1 | 3.6 | 15.8 | 8.4 | 4.0 | 0.8 | 7.3 | 0.5 | 0.009 | 0.032 | 0.003 |
| 15 | 0.015 | 1.9 | 3.2 | 17.0 | 9.0 | 4.3 | 0.8 | 7.9 | 0.4 | 0.010 | 0.035 | 0.003 |

TABLE 2

| No | (Ti + 0.5Nb)/Al | Mo + 0.5W |
|---|---|---|
| 1 | 1.82 | 5.75 |
| 2 | 2.11 | 6.00 |
| 3 | 2.16 | 5.90 |
| 4 | 1.95 | 4.75 |
| 11 | 1.72 | 4.45 |
| 12 | 1.84 | 6.00 |
| 13 | 1.76 | 4.40 |
| 14 | 1.83 | 4.45 |
| 15 | 1.79 | 4.75 |

TABLE 3

| No | Solid solution treatment condition | Aging treatment condition |
|---|---|---|
| 1 | 1090° C. × 4 h/air cooling | 760° C. × 16 h/air cooling |
| 2 | 1090° C. × 4 h/air cooling | 760° C. × 16 h/air cooling |
| 3 | 1080° C. × 4 h/air cooling | 760° C. × 16 h/air cooling |
| 4 | 1080° C. × 4 h/air cooling | 760° C. × 16 h/air cooling |
| 11 | 1080° C. × 4 h/air cooling | 760° C. × 16 h/air cooling |
| 12 | 1080° C. × 4 h/air cooling | 760° C. × 16 h/air cooling |
| 13 | 1100° C. × 4 h/air cooling | 760° C. × 16 h/air cooling |
| 14 | 1100° C. × 4 h/air cooling | 760° C. × 16 h/air cooling |
| 15 | 1060° C. × 4 h/air cooling | 760° C. × 16 h/air cooling |

An aging treatment material which has been subjected to an aging treatment was measured for crystal grain size in accordance with ASTM-E112. Furthermore, the length of twin crystal boundaries and the length of crystal grain boundaries within 200 μm×200 μm were measured by an electron-backscatter-diffraction apparatus, to calculate the twin crystal amount (the ratio of the length of twin crystal boundaries with respect to a sum of the length of twin crystal boundaries and the length of crystal grain boundaries).

Furthermore, a tensile test at a test temperature of 650° C. was performed to evaluate 0.2% proof stress. Furthermore, the creep rupture time at a test temperature of 725° C. and a load stress of 630 MPa was evaluated. The result is illustrated in Table 4.

TABLE 4

| No | Crystal grain size | Twin crystal amount (%) | 0.2% proof stress (MPa)/650° C. | Creep rupture time (h)/725° C. |
|---|---|---|---|---|
| 1 | 8 | 56 | 1105 | 192.5 |
| 2 | 9.5 | 59 | 1083 | 221.6 |
| 3 | 9.5 | 58 | 1104 | 155.9 |
| 4 | 8.5 | 60 | 1092 | 144.2 |
| 11 | 7 | 38 | 1031 | 101.5 |
| 12 | 11.5 | 46 | 1186 | 88.6 |
| 13 | 10 | 45 | 1070 | 59.7 |
| 14 | 9.5 | 40 | 1112 | 92.7 |
| 15 | 7 | 42 | 885 | 105.1 |

As demonstrated in Table 3, only the samples of the present invention (Nos. 1 to 4) exhibit a 0.2% proof stress of more than 1050 MPa and a creep rupture time of 130 h or more. As understood from this, these have favorable mechanical properties at a high temperature of 650° C. or higher.

It was confirmed that according to such mechanical properties, these are suitable particularly as an alloy for low-pressure turbine disks of airplane engines.

Next, a large prototype of the Ni-base super alloy according to the present invention, which has the composition indicated in Table 5, was forged. A 2-ton ingot was prepared by triple melting which includes vacuum melting, electroslag remelting, and vacuum arc melting.

Next, the ingot was subjected to a homogenization treatment, followed by hot forging. In the hot forging, a glass lubricant was applied on the whole surface of the ingot. The heating temperature was defined to be 1050 to 1100° C., which is not higher than the solution temperature of γ'. In the hot forging, upset forging was followed by cogging to prepare a billet having a diameter of 230 mm and a length of 2100 mm. It was confirmed that during the hot forging, cracks and significant flaws were not caused, and even a large-sized material can be sufficiently subjected to hot working.

TABLE 5

| C | Al | Ti | Cr | Co | Fe | Mo | W | Nb | B | Zr | Mg |
|---|---|---|---|---|---|---|---|---|---|---|---|
| 0.016 | 1.46 | 3.82 | 15.07 | 15.46 | 3.45 | 4.80 | 2.46 | 0.41 | 0.007 | 0.02 | 0.001 |

The invention claimed is:

1. An Ni-base super alloy comprising 0.001 to 0.100 mass % of C, 1.0 to 4.0 mass % of Al, 2.0 to 4.5 mass % of Ti, 12.0 to 18.0 mass % of Cr, 11.1 to 18.0 mass % of Co, 1.2 to 12.0 mass % of Fe, 1.5 to 6.5 mass % of Mo, 0.5 to 6.0 mass % of W, 0.1 to 3.0 mass % of Nb, 0.001 to 0.050 mass % of B, 0.001 to 0.100 mass % of Zr, 0.02 mass % or less of Mg, and Ni and impurities as a remainder, wherein the Ni-base super alloy has a composition satisfying (Ti+0.5Nb)/Al being 1.0 to 3.5 mass % and Mo+0.5 W being 3.5 to 7.0 mass %, and the length of twin crystal boundaries is 50% or more with respect to a sum of the length of twin crystal boundaries and the length of crystal grain boundaries.

* * * * *